United States Patent [19]

Moore

[11] 3,969,838

[45] July 20, 1976

[54] SIGN

[75] Inventor: Charles T. Moore, Minneapolis, Minn.

[73] Assignee: Dayton-Hudson Corporation, Minneapolis, Minn.

[22] Filed: Aug. 13, 1975

[21] Appl. No.: 604,138

[52] U.S. Cl. ..... 40/140
[51] Int. Cl.[2] ..... G09F 7/02
[58] Field of Search ..... 40/63, 64, 104, 16.2, 40/142

[56] References Cited

UNITED STATES PATENTS

| | | | |
|---|---|---|---|
| 2,588,635 | 3/1952 | Junkin | 40/16.2 |
| 2,855,711 | 10/1958 | Bloom | 40/140 |
| 3,174,239 | 3/1965 | Cramer | 40/16.2 |
| 3,458,945 | 8/1969 | Edwards | 40/140 |
| 3,722,120 | 3/1973 | Finkel | 40/140 |
| 3,778,915 | 12/1973 | Freeman | 40/140 |

*Primary Examiner*—Louis G. Mancene
*Assistant Examiner*—Wenceslao J. Contreras
*Attorney, Agent, or Firm*—Burd, Braddock & Bartz

[57] ABSTRACT

A sign for identifying merchandise in stores and markets characterized by a double-faced elongated rectangular generally flat sign holder having a pair of back-to-back channel members for receiving interchangeable sign cards and having end members, at least one of which is removable. The sign holder may be supported cantilevered from one end, or suspended, or it may be supported by one or more bottom standards. The signs are of simple construction, distinctive appearance, and the informational indicia displayed is quickly and easily changed.

7 Claims, 9 Drawing Figures

SIGN

This invention is directed to interchangeable signs of the type used in association with the display of merchandise in stores and markets. The signs may be mounted in any of a wide variety of locations including merchandise display stands, wall brackets, free-standing standards, and the like. The signs, according to the present invention, are characterized by an elongated rectangular generally flat sign holder body composed of a pair of channel members in back-to-back relation, each of the channel members being adapted to receive an interchangeable card bearing informational indicia, and having end members, at least one of which is removable for insertion and removal of sign cards in the holder. The sign may be supported cantilever fashion from one form of specially adapted end member engageable with a slotted bracket, or it may be supported in a vertical standard.

The sign, according to the present invention, is illustrated in the accompanying drawings in which.

Figure 1:
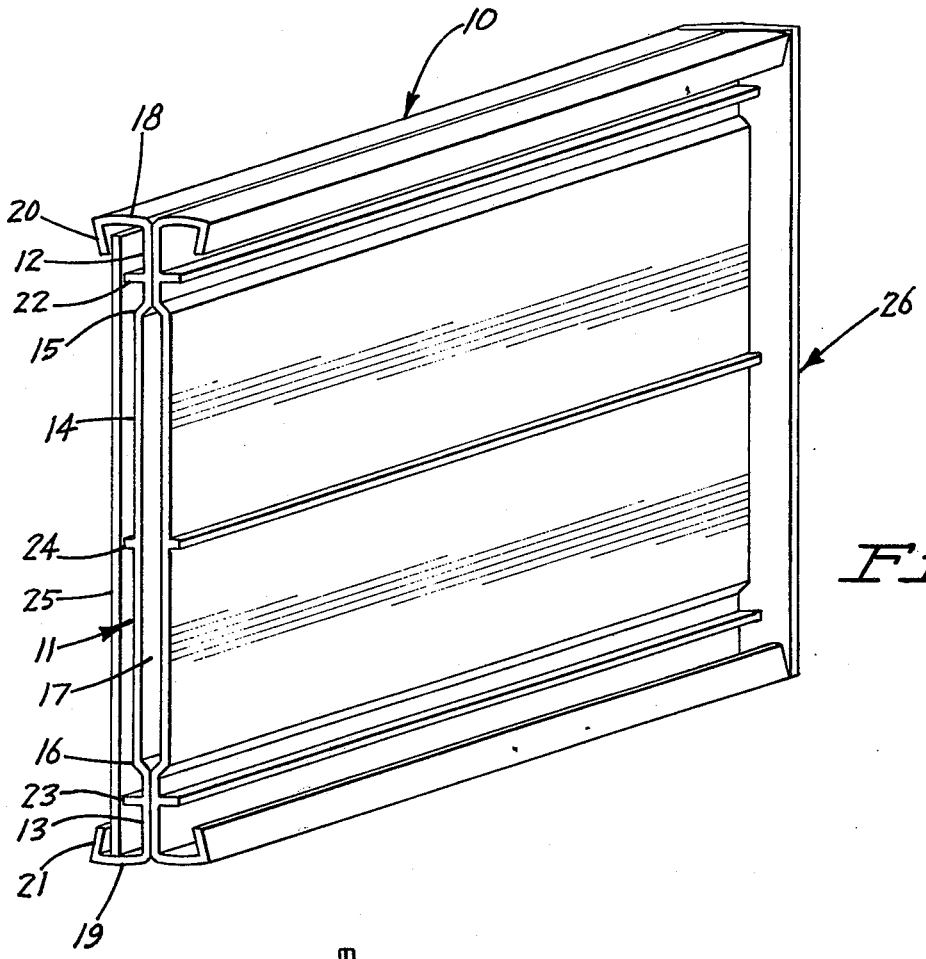
FIG. 1 is a perspective view of a sign holder body with one end member removed to show details of construction.

Referring now to the drawings, and particularly to FIG. 1, there is shown an elongated rectangular generally flat sign holder body, indicated generally at 10, and comprised of a pair of identical mirror image channel members, indicated generally at 11, secured in back-to-back relation. Each channel member has a back plate having flat top and bottom edge portions 12 and 13 lying generally in a common plane. The sign holder is assembled with the flat edge portions of two abutting channel members in back-to-back contact, secured as by an adhesive layer or equivalent fastening means. The channel member back plate also has a flat mid-portion 14 displaced slightly outwardly from the common plane of edge portions 12 and 13 by means of angular or arcuate shoulders 15 and 16, respectively. This results in the assembled structure in a narrow tongue-receiving slot or groove 17 formed between the mid-portions of the back plates. Slot 17 serves to mount the sign holder end members, as explained in detail hereinafter.

Each channel member has a pair of outwardly extending flanges 18 and 19 contiguous with the top and bottom edges, respectively, of the channel back plate. While shown as slightly arcuate, flanges 18 and 19 may, of course, be flat. Flanges 18 and 19 each has a lip 20 and 21, respectively, extending inwardly from the top and bottom edges of the sign holder, and desirably inclined slightly inwardly toward the back plate, as shown.

A longitudinal rib 22 projects from the flat top edge portion 12 of the channel back plate spaced inwardly from the top flange 18 by a distance at least equal to the width of retaining lip 20, and preferably slightly farther as shown, so as to provide an open space between the edge of the lip 20 and edge of rib 22. A similar rib 23 projects from the flat bottom edge portion 13 of the channel member back plate. One or more further longitudinal ribs project from the mid-portion 14 of the channel back plate. The free edges of ribs 22–24 desirably lie generally in a common plane. The ribs perform a dual function. They impart strength and rigidity to the channel members.

The ribs also function as back supports for sign card 25 which is of length corresponding generally to the length of the sign holder and of width slightly less than the distance between the inside surfaces of flanges 18 and 19 so as to fit within the channel with a slide fit. Sign card 25 bears appropriate identifying indicia. It is inserted into the sign holder from one end with its bottom resting in flange 19, its top and bottom edges retained by lips 20 and 21, respectively, and its back generally supported by the free edges of longitudinal ribs 22–24. Normally a card 25 will be inserted in each channel except where only one side of the sign is visible, as when mounted against a wall.

Figure 2:
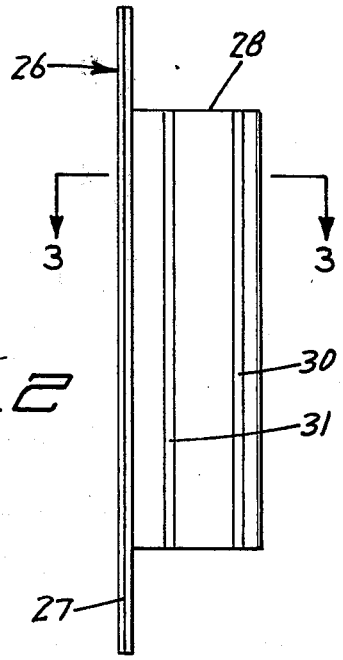
FIG. 2 is an elevation of one form of sign holder end member.
Figure 3:
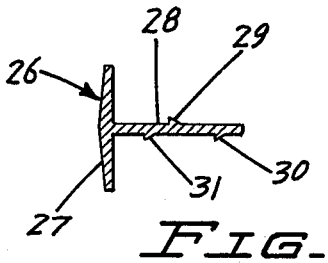
FIG. 3 is a section on the line 3—3 of FIG. 2.

The open ends of the sign holding body are closed by means of end members. One form of end member, indicated generally at 26, is shown in detail in FIGS. 2 and 3. End member 26 includes a generally flat plate 27 of length corresponding to the width of the sign holder 10 and width substantially equal to the combined width of the two flanges 18. The end member is provided with a central generally flat longitudinally extending tongue 28 projecting from one side of plate 27 perpendicular thereto. Tongue 28 is spaced inwardly from the ends of plate 27, being of a length adapted to be received in and engaged by tongue-receiving slot 17 so as to hold plate 27 perpendicular to the plane of the sign holding body at the end thereof. To facilitate the engagement of tongue 28 in slot 17 and retention of the end member in place, the tongue is desirably provided with a plurality of longitudinal ribs 29–31 on opposite sides of the tongue.

Figure 4:
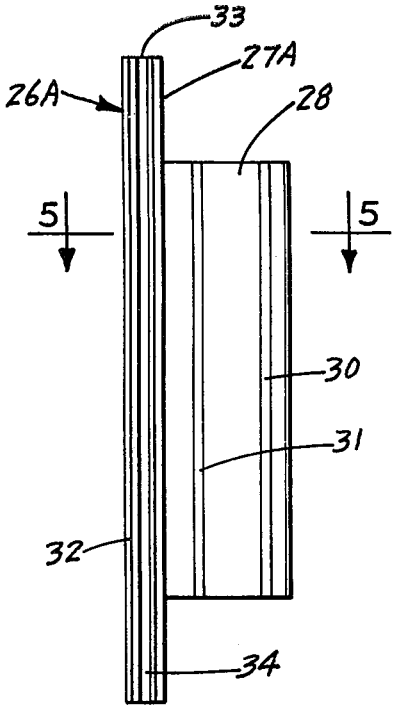
FIG. 4 is an elevation of another form of sign holder end member.
Figure 5:
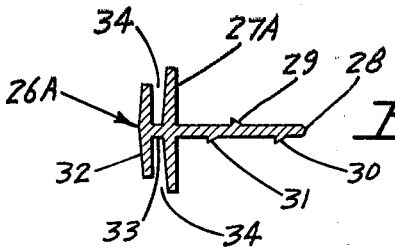
FIG. 5 is a section on the line 5—5 of FIG. 4.
Figure 7:
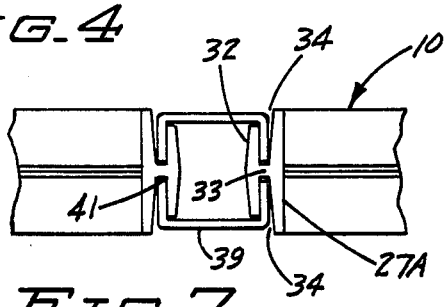
FIG. 7 is an enlarged fragmentary top view along the line 7—7 of FIG. 6.

An alternative form of sign holder end member 26A is shown in FIGS. 4 and 5. This form of end member includes a generally flat plate 27A, projecting tongue 28, etc., as already described. The alternative form of end member has a further generally flat plate 32 of length generally equal to that of plate 27A and slightly lesser width. Plate 32 is supported by and spaced from plate 27A by means of a longitudinal connecting rib 33, forming a flat T key. A pair of longitudinal slots 34 are defined between plates 27A and 32 to permit engagement with a slotted bracket, as seen in FIG. 7. The walls of slots 34 preferably diverge slightly from rib 33 to facilitate insertion of the end member into a slotted bracket and to facilitate removal therefrom. End member 26A is inserted in the end of sign holder 10 in the same manner as already described. At least one of the end members must be fitted with sliding telescopic engagement only so as to permit removal for replacement of sign cards. One end member, however, may be permanently secured, as by means of adhesive or the like, if desired.

Figure 6:
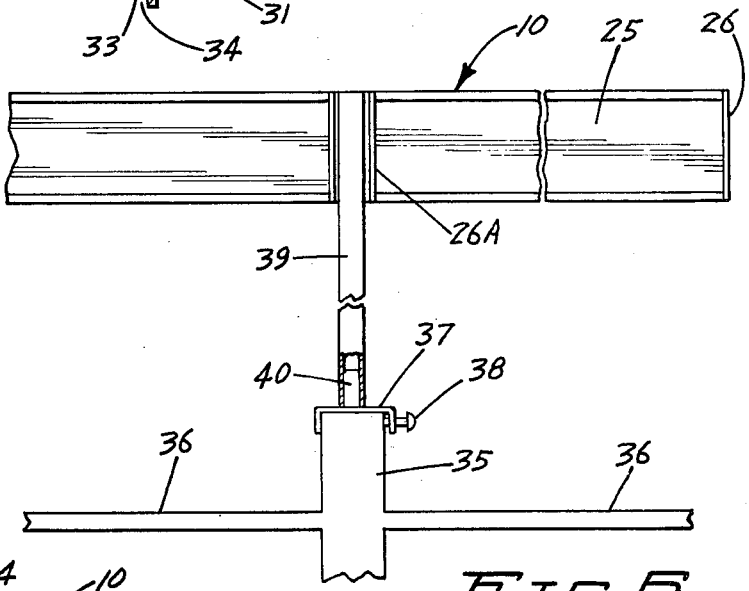
FIG. 6 is an elevation showing one form of mounting signs cantilever fashion.

Referring to FIGS. 6 and 7, there is shown one form of mounting the sign, according to the present invention, for display purposes. There is shown in fragmentary end view the top portion of a free-standing island or gondola display stand having a central vertical longitudinal wall 35 supporting a plurality of shelves 36 for the display of merchandise. A clamp 37 may be secured at any desired location along the top of the display stand and secured, as by means of thumb screws 38 or equivalent fastening means. Clamp 38 supports a post or standard 39 desirably in the form of a hollow square tube fitted over a corresponding square boss 40 projecting from the top of clamp 37.

The surfaces of standard 39 adjacent the top end thereof are provided with central vertical keyway slots 41 (FIG. 7), each adapted to receive a sign holder end member 26A to support the sign holder 10 cantilevered over the displayed merchandise so that it is confronted by the customer passing through the aisle between adjacent display stands. If desired, the signs may be similarly mounted longitudinal of the display stands simply by rotating the standard 39 one-quarter turn on boss 40. Both types of display may be incorporated in a single standard by providing the standard with slots on each of its four sides. By use of suitable slotted brackets, signs may be similarly mounted on walls, door frames, structural columns, and the like. An end member 26 is disposed at the opposite end of the sign holder. Where desired, the sign may be supported at both ends by end members 26A engaged in appropriately spaced slotted standards.

Figure 8:
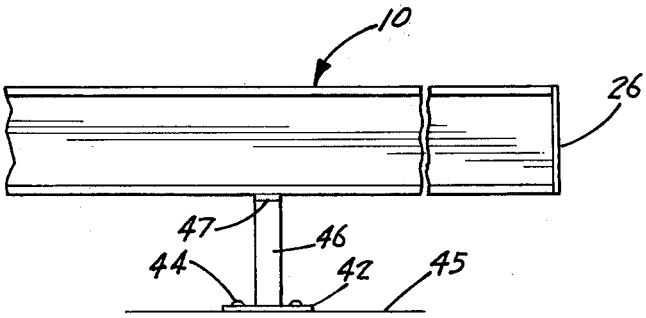
FIG. 8 is an elevation of an alternative form of mounting.
Figure 9:
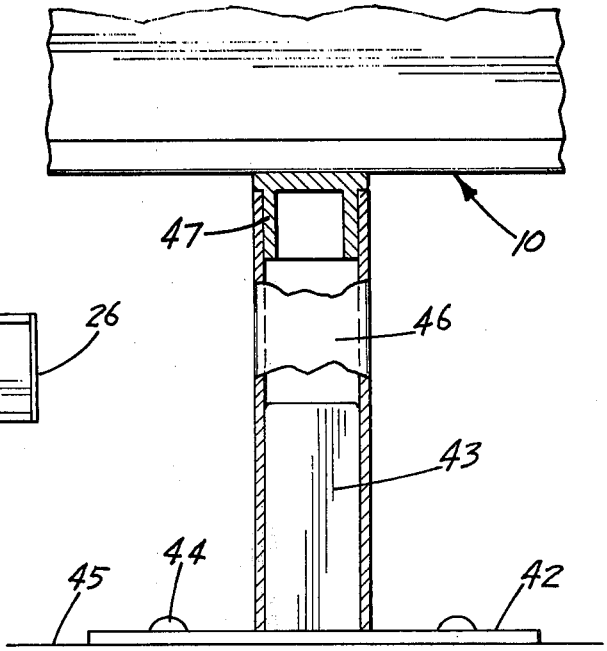
FIG. 9 is an enlarged fragmentary elevation, partly in section, showing details of the mounting means.

In FIGS. 8 and 9, there is shown another form of sign mounting. A flat plate 42 supporting a boss 43 is adapted to be fastened, as by means of screws 44, to the top surface 45 of a display stand or the like. Boss 43 is desirably of square cross section and engages a post or standard 46 of tubular form adapted to engage the boss 43. A similar boss 47 is secured to the bottom edge of sign holder 10 and similarly engages the top end of post 46 to support the stand. While sign holder 10 is illustrated with a single support, in some instances, as where the sign is quite long, it may be desired to have a similar support spaced inwardly from both ends of the sign. This form of sign is fitted with an end member 26 at each end of the sign holder.

The sign holder elements are desirably formed from lightweight materials by extrusion. Extrusible synthetic resinous materials such as acrylics, cellulosics, fluorocarbons, polyamides, styrenes, vinyls, and the like may be used. Extrusible lightweight metal such as aluminum may also be used. Although the indicia bearing member 25 is referred to as a card and ordinarily would be a paper or cardboard material, obviously it may also be formed from plastic sheet material or the like as appropriate for any particular purpose. In some instances, for example, the sign card may be formed from plastic with raised lettering for greatest impact. By fitting the sign holder with a pair of spaced apart eyelets along its top edge, the sign may be suspended by conventional means.

It is apparent that many modifications and variations of this invention as hereinbefore set forth may be made without departing from the spirit and scope thereof. The specific embodiments described are given by way of example only and the invention is limited only by the terms of the appended claims.

The embodiments of the invention in which an exclusive property or privilege is claimed are defined as follows:

1. An interchangeable sign comprising:

A. an elongated rectangular generally flat sign holder body having a pair of channel members disposed in back-to-back relation, each of said channel members having:

1. a back plate having flat top and bottom longitudinal edge portions lying in a common plane and a flat mid-portion displaced slightly outwardly therefrom, whereby, when said back plates are secured in back-to-back relation, a narrow tongue-receiving slot is formed between the mid-portions of the back plates,
2. a pair of flanges extending outwardly from the top and bottom edges of said back plate,
3. a lip extending inwardly from the free edges of said flanges,
4. a pair of parallel longitudinal ribs projecting from the top and bottom edge portions of said back plate spaced inwardly from the top and bottom flanges by a distance at least equal to the width of said lips, and
5. at least one further longitudinal rib projecting from the mid-portion of the back plate, B. an end member at each end of said body, each of said end members having:

1. a generally flat plate lying in a plane perpendicular to the plane of the body, said plate having a width substantially equal to the combined width of the two flanges at the top and bottom of the body and a length substantially equal to the width of the body, and
2. a generally flat longitudinal tongue projecting from one side of said end member plate, perpendicular thereto and spaced inwardly from the ends of the plate, said tongue being in engagement with the tongue-receiving slot at the end of the body, and C. an interchangeable sign card held in at least one side of said sign holder body, said sign having indicia thereon and being formed from flat sheet material of generally the size and shape of the body to fit with a slide fit therein, the top and bottom edges of said sign card being retained by said flange lips and the back of said card being supported by said longitudinal ribs.

2. A sign according to claim 1 further characterized in that said end member tongue is provided with a plurality of longitudinal ribs.

3. A sign according to claim 1 further characterized in that at least one of said end members is provided with support means for suspending said sign holder.

4. A sign according to claim 3 further characterized in that said support means comprises a flat T key including a central longitudinal rib on the outer surface of said end member plate and a generally flat further plate supported by said rib generally parallel to said surface, said key engageable with a vertical slot to support said sign.

5. A sign according to claim 1 further characterized in that at least one of said end members is removable for interchange of sign cards.

6. A sign according to claim 1 further characterized in that support means for said sign holder are provided, said means comprising at least one boss member affixed to the bottom edge of the sign holder and projecting vertically downward therefrom, said boss member engageable with a tubular sign support.

7. A sign according to claim 1 further characterized in that the free edges of said longitudinal ribs lie generally in a common plane.

* * * * *